United States Patent [19]

Olson et al.

[11] 4,401,510

[45] Aug. 30, 1983

[54] PROCESS FOR HEATING UP WOOD CHIPS PRIOR TO STEAMING AND PULPING

[75] Inventors: Torbjörn Olson, Moliden; Lars G. Olauson, Angered; Carl-Johan Candolin, Örnsköldsvik, all of Sweden

[73] Assignee: MoDo-Chemetics AB, Ornskoldsvik, Sweden

[21] Appl. No.: 297,400

[22] Filed: Aug. 28, 1981

[30] Foreign Application Priority Data

Aug. 29, 1980 [SE] Sweden ..... 8006046

[51] Int. Cl.[3] ..... D21C 1/02; D21C 11/10

[52] U.S. Cl. ..... 162/19; 159/47.3; 162/46; 162/47; 162/68

[58] Field of Search ..... 162/47, 19, 68, 65, 162/46, 39; 159/47 WL, 47.3

[56] References Cited

U.S. PATENT DOCUMENTS 3,215,587 11/1965 Guerrieri ..... 162/19

3,425,477 2/1969 Farin ..... 162/47

4,274,911 6/1981 Kroneld et al. ..... 162/47

OTHER PUBLICATIONS

Olauson, "Heat Economy Improves With Lockman Pre-evaporation Using Digester Flash Steam", Pulp & Paper, Canada, vol. 80, No. 3, 3/79, p. T65.

*Primary Examiner*—Steve Alvo

[57] ABSTRACT

A process is provided for heating up wood chips in one or more stages at progressively higher temperatures prior to steaming and pulping in an economical manner at a considerable cost saving; heating the chips in at least a first preheating stage directly with moisture-saturated hot air, optionally admixed with inert gas, having a temperature within the range from about 55° to about 99° C., preferably from 70° to 90° C., having been brought to that temperature in a heat exchanger with hot water or air heaters with waste gases, such as gases drawn at different levels from an evaporator, for example, a Lockman pre-evaporator column.

9 Claims, 3 Drawing Figures

PROCESS FOR HEATING UP WOOD CHIPS PRIOR TO STEAMING AND PULPING

In the manufacture of cellulose pulps from wood chips, the chips normally are heated by steaming in order to enhance penetration and diffusion of pulping chemicals into the chips, while at the same time facilitating the release of lignin, resins, etc., from the chips.

Various preheating methods are described in the literature. Swedish Pat. No. 149,053 simultaneously moistens and carries wood chips to the top of a digester, or to chip bins or silos, or to a steaming vessel using a flow of water which has been heated to from 30° to 40° C. with fresh steam, and which may contain a minor quantity of alkali. This method requires special apparatus, and expensive fresh steam. Furthermore, the chips become saturated with water, which impedes impregnation of the chips with pulping liquor, and introduces an unnecessarily large amount of water, which dilutes the waste liquor, and thus increases the cost of chemicals recovery.

U.S. Pat. No. 3,215,587, patented Nov. 2, 1965 to Guerrieri, discloses a system which includes a preheater wherein the wood chips or like cellulosic material is preheated, a drier wherein the preheated chips are dried, a vacuum tank wherein the dried chips are degassed and subsequently submerged in cooking liquor to form a chip-liquor suspension, heat exchangers for raising the suspensions to the cooking temperature, and a digester.

Wood chips are introduced into the preheater. Air is introduced into the bottom of the preheater and passed in countercurrent flow to the chips descending through the preheater. The volume of air being introduced into the preheater is sufficient to cause the chips to be maintained as an expanded mass. The chips are heated by means of steam jackets which are provided with steam to a temperature slightly below the boiling point of water and some or all of the surface moisture on the chips is removed. The main object of this treatment is to avoid subsequent condensation in the drier. The chips in the preheater may be alternatively heated by passing air which has been heated to a temperature sufficient to heat the chips to process temperature, thereby eliminating the need for providing steam jackets.

The preheated chips are passed from the bottom of the preheater into the upper portion of a drier. In the process of vaporizing the water contained in the pores of the chips, a substantial portion of the gases occluded within the pores is also removed from the chips. A portion of the vapor is recycled to the bottom of the drier which causes the chips to form an expanded mass within the drier.

The remainder of the vapor is passed to a direct contact condenser (not shown) to recover the heat content thereof. Additionally, the water vapor that is withdrawn will to a considerable extent displace air from the pores of the chips.

The chips withdrawn from the drier are dry and superheated in respect to the saturation temperature of the water vapor therein, and are fed into a vacuum tank where substantially all the remaining air and moisture content of the chips is removed.

Swedish Pat. No. 227,648, U.S. Pat. No. 3,401,085, patented Sept. 10, 1968 to Croon et al., heats chips stored in piles outdoors at temperatures of 0° C. or below, in order to produce a more uniform pulp raw material, blowing hot air or steam into the bottom of the piles to initiate enzymatic hydrolysis of the extractive substances of the wood. The hydrolysis is exothermic, and increases the temperature throughout the whole pile of the stack. In this way the bottom layer of chips is heated, preferably to between 1° and 5° C., at most to 30° C., by introducing steam (hot air) into the pile at short spaced intervals of time through a system of pipes in the bottom of said stack. After storage, the chips cool down while being transported to the digester.

Preheating wood chips to from about 0° C. to 95° C. in a chip bin can be done by blowing into the chips secondary steam having a temperature somewhat in excess of 100° C. This is not a cheap step, however, since this kind of steam is valued at nearly the value of fresh steam. Moreover, the air displaced from the chip bin and the accompanying volatile flammable organic constituents are driven as gases from the wood and vented to the surrounding atmosphere, which is environmentally unacceptable, since such gases create a risk of fire and explosion.

In consideration of the high energy costs involved, attempts are being made in the pulp industry to improve the heat economy of the unit operations employed. In this respect, those operations which include a very high drop in temperature are the first to be studied, since here the amount of energy to be saved is the greatest. One such unit operation is the preheating of wood chips prior to pulping using fresh steam in a steaming vessel to a temperature of 125° C. In this case, the temperature of the chips is raised from about 0° C. to 125° C. in a single step, which is wrong both from the thermo-technical and the thermo-economical aspect. In recent years, certain pulp manufacturers have preheated the chips in two stages, using steam at a temperature slightly above 100° C. in the first stage, and steam at 125° C. in the second stage. Although this is better economically, it does not result in satisfactory heat economy.

The aforementioned problems are resolved by the process of the invention by preheating wood chips prior to steaming to progressively higher temperatures in one or more stages, after which the chips are finally heated in a steaming vessel to a temperature of within the range from at least about 115° to at least about 125° C. In the first preheating stage, and in the stage or stages immediately following said first stage, the chips are heated directly with moisture-saturated hot air, optionally admixed with an inert or neutral gas, such as nitrogen, carbon dioxide, stack gases or flue gases, at a temperature within the range from about 55° to about 99° C., preferably from 70° to 90° C.

Figure 1:
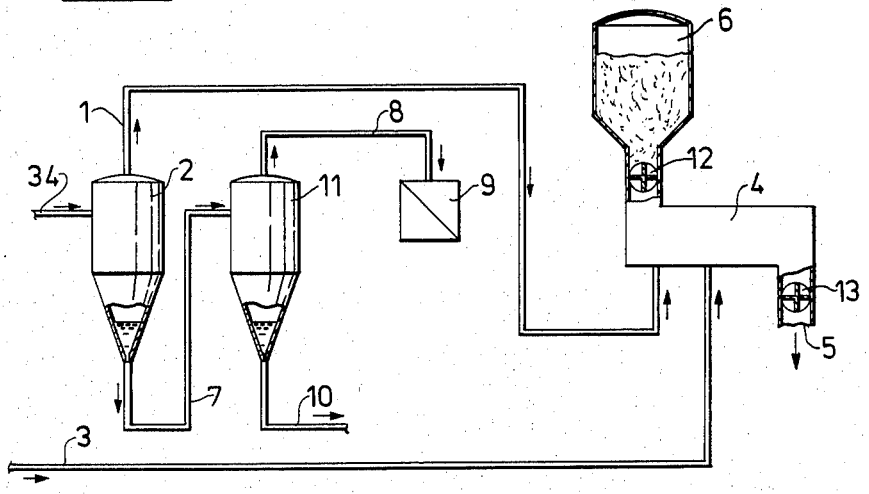
Fig. 1 PRIOR ART
FIG. 1 is a flow sheet showing the most commonly used system for steaming wood chips.

The process of the invention is applicable to wood chips obtained by chipping wood logs from any kind of hardwood or softwood, such as spruce, pine and birch and mixtures thereof, and used as a starting material in the manufacture of cellulose pulps by any of the available chemical, semichemical, chemimechanical and mechanical processes, such as the sulfite, sulfate, polysulfide, soda, refiner, and thermomechanical pulping processes.

Preheating of wood chips in accordance with the invention is preferably carried out while the chips are passed through a preheating zone. This in a pulp mill can take the form of a chip bin, which is normally placed in front of and above the wood chip steaming vessel. The chips are preheated continuously in the bin as they pass through the bin from one end to the other by hot, moisture-saturated air blown into the bin at a number of spaced locations, the temperature of the chips increasing progressively as the chips pass along through the bin.

When the chips reach the end of the bin, and have passed the last air-injection location, at which secondary steam having a temperature of at least 100° C. can be blown in, the temperature of the chips has normally reached about 95° C. The preheated chips then pass to a steaming vessel, where final heating of the preheated chips to within the range from at least about 115° C. to at least about 125° C. is effected by fresh steam. Then, if the chips are to be used for the manufacture of chemical pulp, the hot chips are fed from the steaming vessel directly into a digester before they have cooled down appreciably.

The air used to preheat the chips is suitably heated in a heat exchanger or in a direct contact vessel countercurrently against hot water or hot steam condensate. The steam condensate or hot water suitably has a temperature of about 80° C. The cooled condensate is continuously recycled to a direct condenser, where it is reheated to a temperature of about 80° C., for example, using vacuum steam drawn off from different stages of effects in an evaporator. As the air passes countercurrently in contact with the hot steam condensate or hot water, it is simultaneously washed, which is advantageous when the air instead of being vented is recycled, for reheating and reuse in the chip bin. Recycling of the preheating air is environmentally favorable and is preferred in the process of the invention.

In accordance with the preferred embodiment of the invention, which further improves the heat economy of the process, the air used for heating the chips in the chip bin is heated in an air-heating unit which comprises a plurality of indirect condensers built together, and means for supplying spray water to said air so as to saturate the same with moisture. The thermal energy input to the air-heating unit is obtained, for example, from an evaporator, by supplying to the individual condensers low-grade vacuum steam drawn from different stages or effects in the evaporator. In this embodiment, the saturated hot air is heated to a temperature of about 70° C., before being blown into the chip bin.

In accordance with another suitable embodiment, with which good heat economy is obtained, the air-heating unit is divided into two similar units, which work in parallel, and to each of which there is fed vacuum steam drawn from the evaporator, in a manner such that one unit is supplied with vacuum steam from the higher stages or levels of the evaporator, i.e., the hottest steam, while the other unit is supplied with vacuum steam from the lower stages or levels of the evaporator. In this way, it is possible to obtain two saturated air streams having different temperatures, which can be blown or injected into the chip bin at separate locations. Thus, preheating of the chips can be carried out in three stages, the last stage being with secondary steam.

The secondary steam used in the last stage of the chip preheating process is preferably blown into the chip bin at the exit end. This steam has a temperature of at least 100° C., and, according to the present invention, is suitably withdrawn from an evaporator at a suitable pressure, or from a so-called flash tank, i.e., an expansion vessel, for driving off steam from digester waste liquor. Normally, there are from one to three such expansion vessels per digester, designated flash tank I, flash tank II, flash tank III, etc., in the order of sequence from the digester.

The steam used in the steaming vessel is normally taken from flash tank I after the digester, and has a temperature of about 125° C. However, steam used in the steaming vessel is preferably taken from flash tank II, or from a pre-evaporator coupled to a flash tank I. Steam charged to the steaming vessel in accordance with this latter alternative is purer than steam charged in accordance with the former, and also provides the best heat economy.

The surprisingly good heat economy afforded by the process of the present invention is related to the fact that a large percentage of the heat required to preheat the chips to about 120° C. is provided by air as a carrier medium for waste heat in the form of, for example, low-grade vacuum steam. This is achieved by bringing the pressure of the vacuum steam to atmospheric pressure by addition of air. In this way, the necessity of handling the chips in a vacuum vessel is avoided, while, at the same time, enabling the high heat capacity of vapors having a temperature lower than 100° C. to be utilized. In this case, the air serves mainly as a carrier medium for the steam, which constitutes the heating component. The part played by the air in the transfer of heat is thus relatively small, and of subordinate significance, except when the hot air has a very low final temperature.

The energy costs involved in applying the method according to the invention are very low, because a great deal of the heat required to heat the chips to about 120° C. is supplied by waste heat, which is thus profitably retrieved, the waste heat suitably being in the form of low-grade vacuum steam taken, for example, from an evaporator. Vacuum steam having a temperature of 60° and taken from an evaporator stage is normally wasted.

Another advantage is that, in comparison with direct heating of the chips with hot water, the chips treated in accordance with the invention are not saturated with water during the preheating, which contributes in turn to improved impregnation of the chips with pulping liquor in a subsequent pulping stage, and to a higher quality of the final pulp. A contributory factor in this connection is that air and volatile organic components are displaced from the chips during the preheating of said chips in accordance with the invention.

A further advantage is that the saving in energy afforded by the method according to the invention leads to a reduction in the amount of fresh steam which needs be charged to the steaming vessel.

In the system illustrated in FIG. 1, flash steam having a temperature of about 125° C. and taken from a flash tank I, designated 2 in the Figure, is passed through a pipe 1 to a steaming vessel 4. Fresh steam is also passed to the steaming vessel, through a pipe 3. The chips are heated in the steaming vessel 4 to a temperature of about 120° C., and then the steamed chips are charged to a digester 5 through a gate feeder 13.

Hot, thin liquor obtained from the digesters is charged to the flash tank I through a pipe 34. Liquor in the flash tank I is transferred to a flash tank II, here designated 11, through a pipe 7. Chips are fed to the steaming vessel 4 from a chip bin or silo 6 located above said vessel, through a gate feeder 12. Steam from the flash tank II is not used to preheat the chips, but is transferred to a condenser 9 through a pipe 8.

Figure 2:
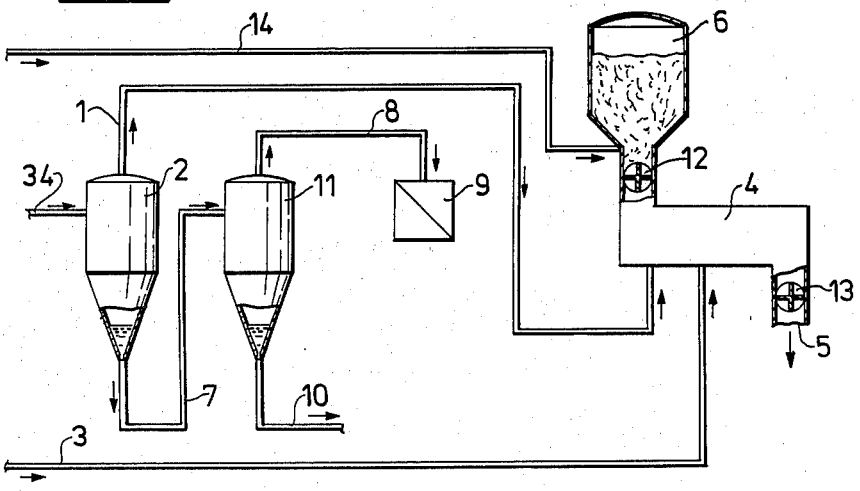
Fig. 2 PRIOR ART
FIG. 2 is a flow sheet showing another known system in which chips in the chip bin are heated with secondary steam.

In the system illustrated in FIG. 2, chips in the chip bin 6 are heated with secondary steam at a temperature of about 105° C. and passed to the bin through a pipe 14. The secondary steam may, for example, originate from an evaporator or from a flash tank. Final heating of the chips (steaming) to about 120° C. is effected in the steaming vessel 4, as in the system of FIG. 1, using flash steam and fresh steam passed to the tank through pipes 1 and 3, respectively.

Figure 3:
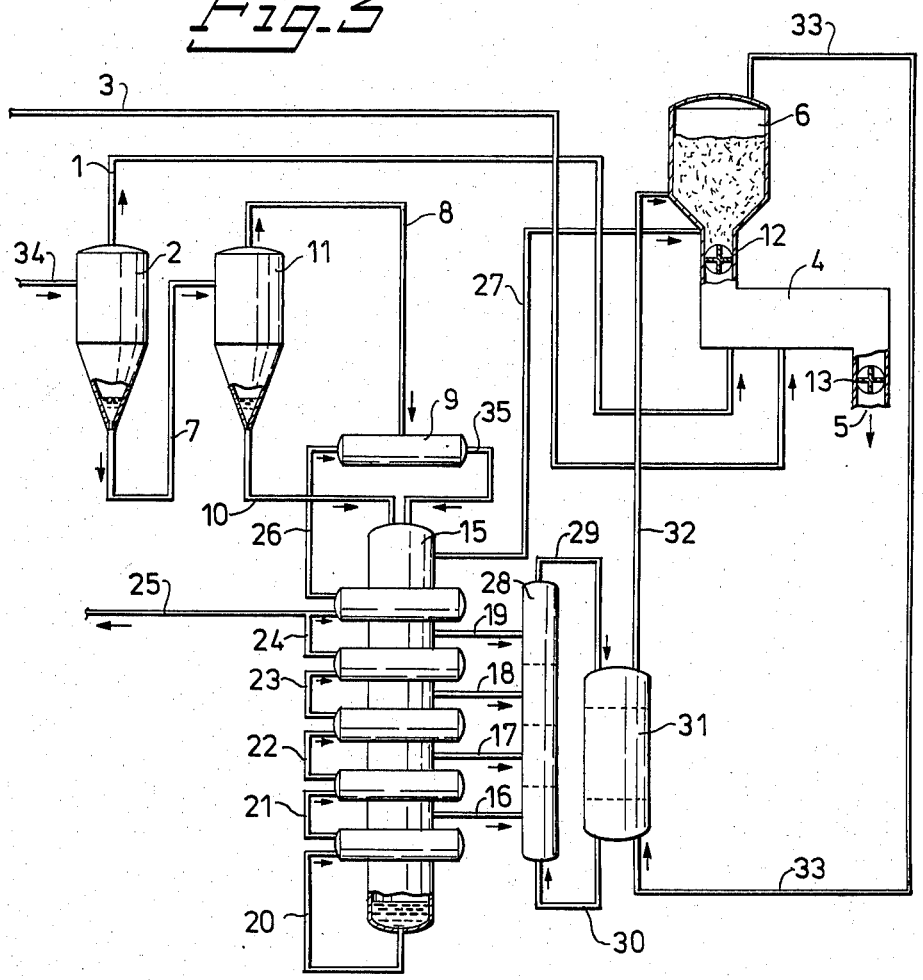
FIG. 3 is a flow sheet showing a preferred embodiment of the invention.

In the system illustrated in FIG. 3, in accordance with the invention, vacuum steam is withdrawn from a pre-evaporator 15, a Lockman column, at different levels through pipes 16,17,18 and 19. Steam condensate from an air heater 31 is passed to a direct condenser 28 through a pipe 30, and is heated in the condenser from a temperature of about 50° C. to a temperature of about 80° C. The resultant hot condensate is then passed through a pipe 29 back to the air heater 31. The air heater 31 is a counter-flow contact column in which relatively cool air is introduced through a pipe 33 and flowed countercurrently to the hot condensate entering the heater 31 through pipe 29.

In this way, the cool air is heated from about 40° C. to about 70° C., while being washed at the same time. Moisture-saturated hot air is taken out from the heater 31 through the pipe 32, and passed to a chip bin or silo 6, into which it is blown near the bottom end. Through condensation and convection the hot, moisture-saturated air is cooled in the chip bin from its inlet temperature of about 70° C. to about 40° C., at the same time as the chips in the bin 6 are preheated to a temperature of about 60° C. This constitutes 30 to 50% of the total preheating requirement.

Further heating of the chips to a temperature of about 105° C. is effected in the chip bin or silo 6, by blowing secondary steam having a temperature of about 105° C. through a pipe 27. This steam is taken from the upper part of the evaporator 15.

Final heating of the chips is effected in the steaming vessel 4, with the aid of flash steam introduced through pipe 1, and having a temperature of about 125° C., together with a requisite amount of fresh steam introduced via pipe 3, thereby imparting to the chips a temperature of about 120° C.

The air cooled in the chip bin 6 is withdrawn through the pipe 33, and recirculated to the bin via the air heater 31.

Similar to the systems illustrated in FIGS. 1 and 2, hot, thin liquor taken from the digesters is passed to the first flash tank (I) 2 through the pipe 34. Steam from the second flash tank (II) 11 is passed through pipe 8 to the condenser 9, where the said steam heats pre-evaporated liquor entering the condenser 9 through a pipe 26. The now hot liquor is passed from the condenser 9 to the top of the pre-evaporator 15 through a pipe 35.

Thin liquor separated from steam in the second flash tank 11 is similarly passed to the top of the pre-evaporator 15 through the pipe 10. Pre-evaporated liquor obtained in the bottom of the pre-evaporator 15 is led upwardly, stepwise, through the heat exchangers of the pre-evaporator, through pipes 20,21,22,23 and 24. A certain amount of pre-evaporated liquor is continuously withdrawn, and passed through pipe 25 to a final evaporation stage.

The following Example in the opinion of the inventors represents a preferred embodiment of the invention.

EXAMPLE 1

In this Example the known process illustrated in FIG. 1 (Control A) and in FIG. 2 (Control B) are compared with the embodiment of the present invention illustrated in FIG. 3 (Example 1).

Wood chips from the same source, spruce, pine, and birch, and mixtures thereof, having a solids content of 50% were used in all three methods, and the comparisons were made on the basis of the following data:

| | |
|---|---|
| Pulp production | 750 tons per day (90%) |
| Pulp yield | 50% |
| Wood solids content | 50% |

The amount of dry wood = the amount of water = (750/24)·(0.90/0.50) = 56.3 t/hr $Cp_{wood}$ = 1.45 kJ/kg°C.

Thus, the amount of heat required to heat the chips from 0° C. to 120° C. is $$56.3(4.2+1.45)\cdot 120 \approx 38{,}200 \text{ MJ/hr}$$

In Control A (illustrated in FIG. 1) the chips were preheated in one step in the steaming vessel 4, using flash steam 1 together with fresh steam 3.

In Control B (illustrated in FIG. 2) the chips were preheated in two stages, firstly in the chip bin 6 with secondary steam 14 to a temperature of about 95° C., and secondly in the steaming vessel 4 with flash steam 1 and fresh steam 3, to a final temperature of about 120° C. It required 30,250 MJ/hr to heat the chips to 95° C. in the chip bin, which corresponds to 13.5 tons/hr of secondary steam at a temperature of 105° C. The amount of flash steam 1 and fresh steam 3 required could, in this case, be correspondingly decreased. If the value of the secondary steam 14 is calculated as 80% of that of the fresh steam, a corresponding saving in fresh steam amounts to 2.7 tons/hr.

In Example 1 (the method according to the invention illustrated in FIG. 3) the chips were heated in three stages, of which the first two were effected in the chip bin 6 and the third in the steaming vessel 4. In the first heating stage the chips were heated with moisture-saturated hot air 32 from the air heater 31 to a temperature of about 60° C. The heat required corresponded to 8.8 tons/hr of fresh steam. Continued heating of the chips to a temperature of about 95° C. was effected by blowing secondary steam 27 having a temperature of about 105° C. into the bottom of the chip bin. The steam required was 4.7 tons/hr. In this case, the amount of flash steam 1 and fresh steam 3 used in the third heating stage in the steaming vessel 4 could be reduced by 13.5 tons/hr. If the value of the secondary steam 27 is calculated as being 80% of that of the fresh steam, the corresponding saving of fresh steam in this case is 9.7 tons/hr.

The savings in steam and the corresponding savings in costs afforded by the three methods relative to Control A as zero are set forth in Table I.

TABLE I

| | Savings in steam tons/hour | Savings in costs per year over Control A |
|---|---|---|
| Control A | — | — |
| Control B | 2.7 | 300,000 |
| Example 1 | 9.7 | 1,100,000 |

As seen from the Table, considerable savings in steam and therefore corresponding savings in cost of operation can be made using the method according to the invention. Compared to Control A, Control B would save 1250 tons of oil, and Example 1, 4600 tons of oil. These savings are considerable when compared with the best known technique (represented by Control B) and the value of the heat-economy in the method according to the invention increases progressively with the increase in energy costs.

Having regard to the foregoing disclosure, the following is claimed as the patentable and inventive embodiments thereof:

1. A process for heating up wood chips in one or more stages at progressively higher temperatures prior to steaming and pulping, which comprises withdrawing vacuum steam from an evaporator for spent pulping liquor at different levels and passing it to corresponding levels in a direct condenser; passing steam condensate at a temperature of about 50° C. through the condenser and heating it to a temperature of about 80° C., passing the resultant hot condensate in countercurrent contact flow with cool air at about 40° C. and heating the cool air to from about 70° C., while washing it, thereby forming moisture-saturated hot air; passing the hot air through a mass of wood chips, thereby preheating the chips to a temperature of about 60° C. while cooling the hot, moisture-saturated air to about 40° C.; withdrawing the cool air and recycling it to the air heating in countercurrent contact flow with said steam condensate; passing secondary steam having a temperature of about 105° C. from the upper part of said evaporator through the chips and thereby heating the chips to a temperature of up to about 100° C., and finally heating the chips with flash steam and fresh steam having a temperature of about 125° C., thereby imparting to the chips in the heating stage a temperature within the range from at least about 115° to at least about 125° C.; digesting the heated wood chips; passing the hot liquor from the digestion to a first flash tank; and then to a second flash tank; passing steam from the second flash tank to said condenser, and heating pre-evaporated liquor in the condenser; passing the hot pre-evaporated liquor from the condenser to an evaporator; passing the hot liquor separated from steam in the second flash tank to the evaporator; feeding evaporated liquor obtained in the bottom of the evaporator upwardly, stepwise, through the evaporator; and then completing evaporation of pre-evaporated liquor.

2. A process according to claim 1 in which the hot air is admixed with inert gas.

3. A process according to claim 1 in which the chips are heated in from two to four preheating stages.

4. A process according to claim 1 in which the chips are heated in two stages immediately before heating with steam, heating the moisture-saturated hot air used in the first stage to about 70° C. with steam condensate at a temperature of about 80° C. in contact in countercurrent flow with said air.

5. A process according to claim 1 in which the chips are heated in three stages immediately before heating with steam; heating the moisture-saturated hot air for use in the first stage to about 70° C.; and heating the moisture-saturated hot air in the second stage to about 90° C.

6. A process according to claim 1 in which steam in the final heating stage is taken from a pre-evaporator for spent pulping liquor.

7. A process according to claim 6 in which the moisture-saturated hot air used for preheating the chips is heated by passing said air over indirect condensers for vacuum steam provided with water spraying means for saturating the air with moisture, said condensers being supplied with vacuum steam taken from different effects in an evaporator.

8. A process according to claim 6 in which the moisture-saturated hot air used for preheating the chips is heated by passing said air in countercurrent contact with hot water at a temperature within the range from about 65° to about 100° C.

9. Apparatus for preheating wood chips prior to steaming and pulping, comprising, in combination and in fluid flow connection:

(a) an evaporator having a plurality of levels from which vacuum steam can be withdrawn;

(b) a condenser receiving and heated by the vacuum steam at corresponding levels, condensing the steam to hot condensate and passing the resultant hot condensate to an air heater;

(c) an air heater carrying relatively cool air in countercurrent flow to the hot condensate from the condenser (b) thereby heating the cool air from about 40° C. to about 70° C., while washing the air and producing moisture-saturated hot air;

(d) a chip bin;

(e) means carrying moisture-saturated hot air from the heater (c) to the chip bin (d) and flowing the air through the chips, thereby heating the chips to a temperature of about 60° C.;

(f) means for withdrawing secondary steam from an upper part of the evaporator (a) and introducing this steam in the chip bin (d) for further heating of the chips;

(g) a steaming vessel for final heating of the chips with flash steam and fresh steam, thereby imparting to the chips a final temperature within the range from at least about 115° C. to at least about 125° C.;

(h) means for withdrawing air cooled in the chip bin (d) and recirculating it to the air heater (a) for return to the bin (d);

(i) a digester receiving the heated chips directly from the steaming vessel (g);

(j) a first flash tank and a second flash tank receiving in sequence liquor taken from the digester (i);

(k) means for passing steam from the first flash tank to the steaming vessel (g);

(l) means for passing steam from the second flash tank to the condenser (b) for heating;

(m) means for passing the hot liquor from the condenser (b) to the evaporator (a);

(n) means for passing liquor separated from steam in the second flash tank to the evaporator (a), liquor in the evaporator (a) being led stepwise through a series of heat exchangers in heat-exchanging relation with the evaporator (a); and (o) means for withdrawing pre-evaporated liquor and passing it to a final evaporating stage.

* * * * *